US009245672B2

(12) United States Patent
Ohbayashi et al.

(10) Patent No.: US 9,245,672 B2
(45) Date of Patent: Jan. 26, 2016

(54) CHIP RESISTOR AND METHOD OF PRODUCING SAME

(71) Applicant: PANASONIC CORPORATION, Osaka (JP)

(72) Inventors: Takashi Ohbayashi, Osaka (JP); Seigo Shiraishi, Osaka (JP); Kazunori Sakai, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 199 days.

(21) Appl. No.: 13/960,749

(22) Filed: Aug. 6, 2013

(65) Prior Publication Data

US 2013/0321121 A1 Dec. 5, 2013

Related U.S. Application Data

(63) Continuation of application No. PCT/JP2012/000951, filed on Feb. 14, 2012.

(30) Foreign Application Priority Data

Feb. 24, 2011 (JP) ..... 2011-038062

(51) Int. Cl.
*H01C 1/012* (2006.01)
*H01C 1/14* (2006.01)
(Continued)

(52) U.S. Cl.
CPC ..... *H01C 1/012* (2013.01); *H01C 1/14* (2013.01); *H01C 7/003* (2013.01); *H01C 17/006* (2013.01); *H01C 17/283* (2013.01); *H01C 1/028* (2013.01); *Y10T 29/49082* (2015.01)

(58) Field of Classification Search
CPC ..... H01C 1/14; H01C 1/012; H01C 7/003; H01C 17/006; H01C 17/283
USPC ..... 338/307–309
See application file for complete search history.

(56) References Cited

U.S. PATENT DOCUMENTS 6,023,217 A * 2/2000 Yamada et al. ..... 338/309
6,492,896 B2 * 12/2002 Yoneda ..... 338/309
(Continued)

FOREIGN PATENT DOCUMENTS

JP 56-148804 A 11/1981
JP 63-46872 U 5/1988
(Continued)

OTHER PUBLICATIONS

International Search Report issued in PCT/JP2012/000951 with Date of mailing May 22, 2012.

*Primary Examiner* — Kyung Lee
(74) *Attorney, Agent, or Firm* — McDermott Will & Emery LLP

(57) ABSTRACT

An object of the disclosure is to provide a chip resistor without causing the disconnection in atmosphere of sulfidizing gas and without precipitating silver sulfide on its surface. The chip resistor of the present disclosure includes a resistor layer disposed on a top surface of a substrate; a first upper electrode layer disposed at both sides of the resistor layer and being electrically connected to the resistor layer; and a second upper electrode layer disposed on the first upper electrode layer and including between 75% by weight and 85% by weight (inclusive) of silver particles with an average particle diameter ranging from 0.3 um to 2 um, between 1% by weight and 10% by weight (inclusive) of carbon, and a resin.

10 Claims, 6 Drawing Sheets

(51) Int. Cl.

| | |
|---|---|
| ***H01C 7/00*** | (2006.01) |
| ***H01C 17/00*** | (2006.01) |
| ***H01C 17/28*** | (2006.01) |
| *H01C 1/028* | (2006.01) |

(56) References Cited

U.S. PATENT DOCUMENTS

| | | | | |
|---|---|---|---|---|
| 6,636,143 | B1 * | 10/2003 | Hashimoto et al. | 338/309 |
| 7,161,459 | B2 * | 1/2007 | Harada et al. | 338/22 R |
| 7,782,173 | B2 * | 8/2010 | Urano et al. | 338/307 |
| 7,794,628 | B2 * | 9/2010 | Takashima et al. | 252/511 |
| 2003/0029541 | A1 | 2/2003 | Matsumora | |
| 2004/0160303 | A1 | 8/2004 | Kuriyama | |
| 2004/0164841 | A1 | 8/2004 | Saito et al. | |
| 2004/0262712 | A1 | 12/2004 | Doi | |
| 2007/0151968 | A1 * | 7/2007 | Yamashita et al. | 219/553 |
| 2008/0129443 | A1 | 6/2008 | Tsukada et al. | |
| 2009/0134361 | A1 | 5/2009 | Takashima et al. | |
| 2013/0321121 | A1 * | 12/2013 | Ohbayashi et al. | 338/307 |

FOREIGN PATENT DOCUMENTS

| | | | |
|---|---|---|---|
| JP | 01-159905 | A | 6/1989 |
| JP | 2001-351803 | A | 12/2001 |
| JP | 2002-184602 | A | 6/2002 |
| JP | 2002-222702 | A | 8/2002 |
| JP | 2002-324428 | A | 11/2002 |
| JP | 2004-253467 | A | 9/2004 |
| JP | 2004-259864 | A | 9/2004 |
| JP | 2004-288956 | A | 10/2004 |
| JP | 2007-012908 | A | 1/2007 |
| JP | 2008-218619 | A | 9/2008 |
| JP | 2008-244211 | A | 10/2008 |
| JP | 2009-194129 | A | 8/2009 |
| WO | WO-03/046934 | A1 | 6/2003 |
| WO | WO-2007/032201 | A1 | 3/2007 |

* cited by examiner

CHIP RESISTOR AND METHOD OF PRODUCING SAME

This is a continuation of International Application No. PCT/JP2012/000951, with an international filing date of Feb. 14, 2012, which claims priority of Japanese Patent Application No. 2011-038062, filed on Feb. 24, 2011, the contents of which are hereby incorporated by reference.

TECHNICAL FIELD

The present disclosure relates to a chip resistor used in various electronic devices, and to a method for producing the same.

BACKGROUND ART

The chip resistor as disclosed in Patent Literature 1 is known as a conventional chip resistor.

Hereinafter, the conventional chip resistor and a method for producing thereof will be described with reference to the attached figures.

FIG. 1 illustrates a cross sectional view of the conventional chip resistor (Patent Literature 1). The chip resistor includes insulating substrate 1, resistor layer 3, and upper electrode layer 2. Resistor layer 3 is disposed on the top surface of insulating substrate 1. Upper electrode layer 2 is disposed on the top surface of insulating substrate 1 and so as to contact with resistor layer 3 at left and right sides of resistor layer 3. Also, resistor layer 3 has trimming groove 4 in order to adjust its resistance value. The chip resistor of FIG. 1 further includes protecting layer 5, side electrode layer 6, nickel-plated layer 7, and solder plated layer 8. Protecting layer 5 is disposed so as to cover resistor layer 3. Side electrode layer 6 is disposed at the side of insulating substrate 1, and electrically connected to upper electrode layer 2. Nickel-plated layer 7 and solder plated layer 8 are disposed on the surfaces of upper electrode layer 2 and side electrode layer 6.

CITATION LIST

Patent Literature

PTL 1: Unexamined Japanese Patent Publication No. S56-148804

PTL 2: Unexamined Japanese Patent Publication No. 2002-184602

PTL 3: Unexamined Japanese Patent Publication No. 2004-259864

PTL 4: Unexamined Japanese Patent Publication No. 2004-288956

SUMMARY OF THE DISCLOSURE

Technical Problems

However, in the configuration of the conventional chip resistor as described above, when the chip resistor is mounted to a printed circuit board of an electronic device by solder plated, a gap may be created at the interface between protecting layer 5 and solder plated layer 8 and nickel-plated layer 7 due to heat stress caused by solder plated. When the electronic device to which the chip resistor is mounted is used in an atmosphere where sulfidizing gas is contained and humidity is high, such as a hot-spring area, sulfidizing gas enters into the gap to react with upper electrode layer 2 to form silver sulfide. Since the resulting silver sulfide is growing, silver sulfide continues to precipitate on the top surface of protecting layer 5 and on the plated layer. Therefore, the chip resistor has a problem that its disconnection is caused at the interface of upper electrode layer 2 of the chip resistor.

If upper electrode layer 2 is replaced by an electrode made of silver palladium alloy in order to solve the problem, the time taken until the disconnection is caused becomes longer, but it is not sufficient. If upper electrode layer 2 is replaced by a gold electrode, the disconnection is not caused; however, the gold electrode is damaged by a checker during trimming in order to adjust a resistance value to a predetermined value. In addition, the chip resistor has a problem that gold may be corroded by solder during solder plated to cause its disconnection.

Therefore, there is an approach that a nickel-based resin is used as a second upper electrode layer, as described in Unexamined Japanese Patent Publication No. 2002-184602. In this approach, the chip resistor has a problem that it is difficult to determine whether the chip resistor has a nickel-plated layer for the side electrode layer because the second upper electrode layer is similar type of material as the nickel-plated layer.

In addition, as described in Unexamined Japanese Patent Publication No. 2004-259864, a carbon-based conductive material may be used as a second upper electrode layer. Materials containing silver and carbon as used in a side electrode layer, which are described in Unexamined Japanese Patent Publication No. 2004-288956, may be used. However, conductivity is ensured by carbon in these materials. Since the materials contain a small amount of silver, the nickel-plated layer for the side electrode layer adheres, but the nickel-plated layer has a weak sticking force. Therefore, the chip resistor has a problem that the layer tends to delaminate easily during the subsequent step or by heat stress.

The present disclosure has been devised in order to solve these conventional problems, and an object of the disclosure is to provide a chip resistor without causing the disconnection in atmosphere of sulfidizing gas and without precipitating silver sulfide on its surface.

Solutions to Problems

In order to solve these problems, a chip resistor of the present disclosure includes a substrate having a top surface; a resistor layer disposed on the top surface of the substrate; a first upper electrode layer disposed on the top surface of the substrate and being electrically connected to the resistor layer at both sides of the resistor layer; and a second upper electrode layer disposed on the first upper electrode layer. The second upper electrode layer includes between 75% by weight and 85% by weight (inclusive) of silver particles with an average particle diameter ranging from 0.3 μm to 2 μm, between 1% by weight and 10% by weight (inclusive) of carbon, and a resin.

Advantageous Effect of Disclosure

The present disclosure can provide a chip resistor without causing the disconnection in atmosphere of sulfidizing gas and without precipitating silver sulfide on its surface.

DESCRIPTION OF EMBODIMENTS

Figure 1:
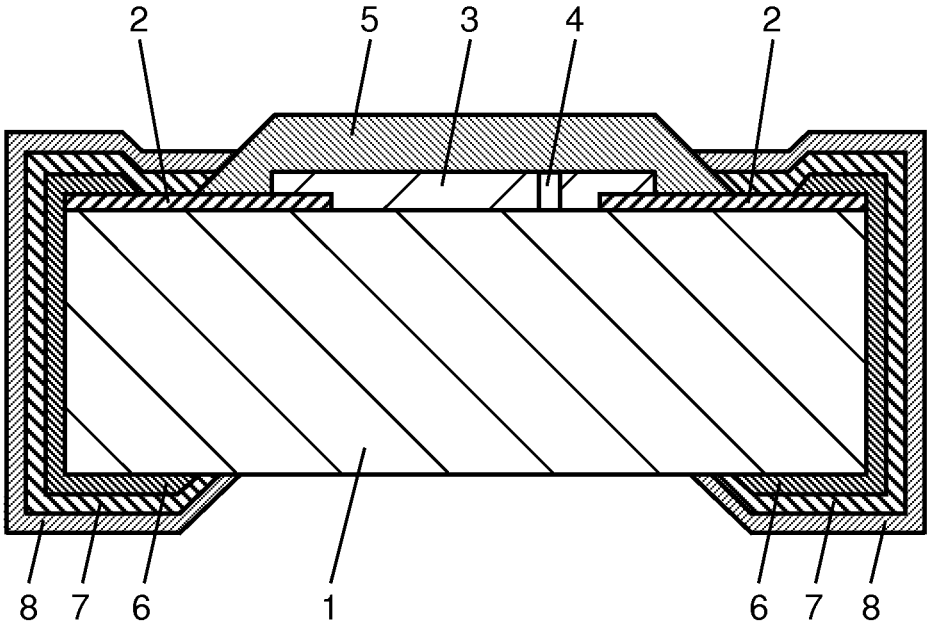
FIG. 1 is a cross sectional view of a conventional chip resistor.
Figure 2:
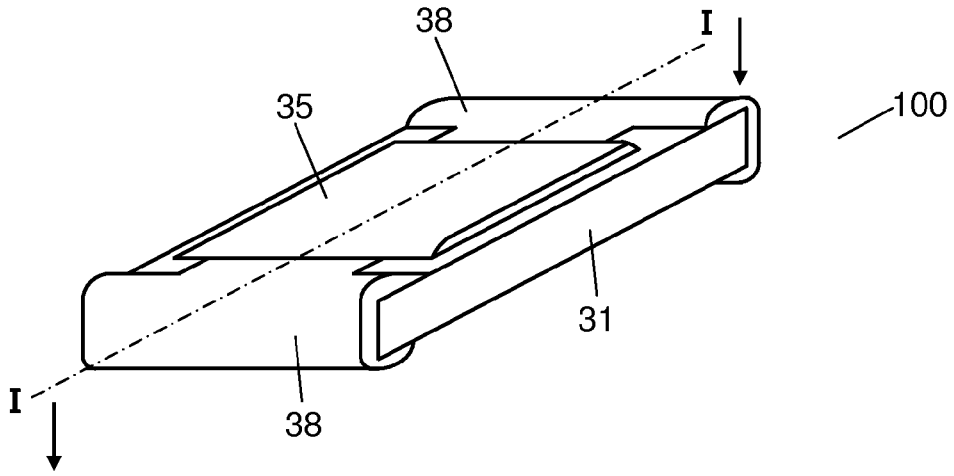
FIG. 2 is a perspective view of a chip resistor according to an embodiment of the present disclosure.
Figure 3:
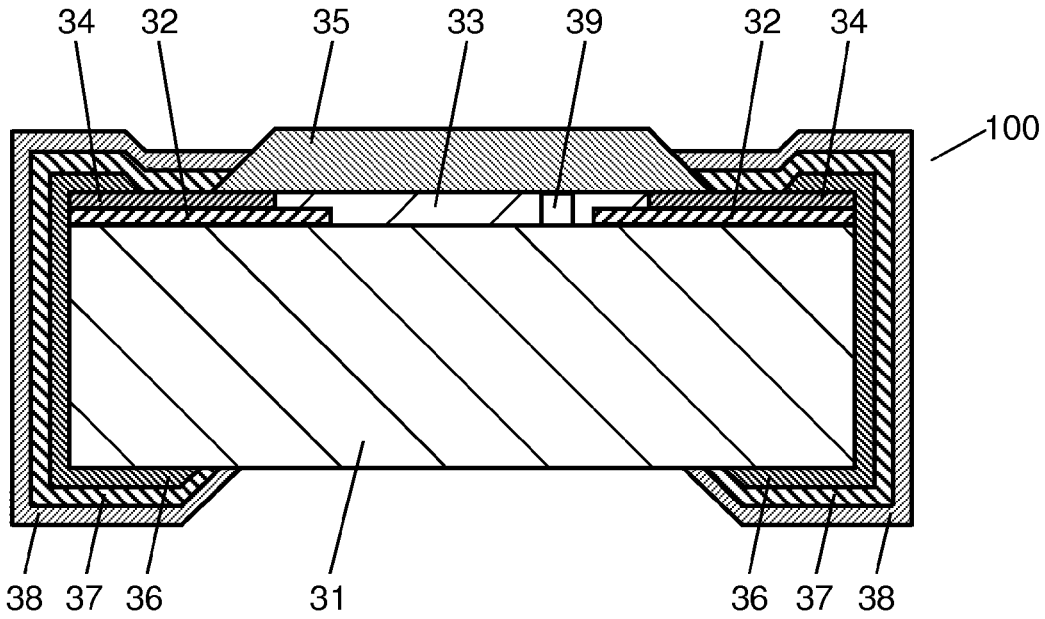
FIG. 3 is a cross sectional view taken by a cross-section I-I of FIG. 2 of the chip resistor according to an embodiment of the present disclosure.

Hereinafter, embodiments of the present disclosure will be described with reference to the attached figures. FIG. 2 is a perspective view of chip resistor 100 according to an embodiment of the present disclosure. The chip resistor of the present embodiment is a square shape. FIG. 3 is a cross sectional view of resistor 100 when taken by I-I of FIG. 2.

Resistor 100 of the present embodiment includes substrate 31, resistor layer 33, first upper electrode layer 32, and second upper electrode layer 34, as shown in FIG. 2 and FIG. 3. Substrate 31 is an insulating substrate. Resistor layer 33 is disposed on the top surface of substrate 31. First upper electrode layer 32 is disposed on the top surface of substrate 31 and so as to contact with resistor layer 33 at left and right sides of resistor layer 33. Second upper electrode layer 34 is disposed on the first upper electrode layer. Also, resistor layer 33 has trimming groove 39 in order to adjust its resistance value.

Resistor 100 of the present embodiment further includes protecting layer 35, side electrode layer 36, nickel-plated layer 37, and solder plated layer 38. Protecting layer 35 is disposed so as to cover resistor layer 33 and a part of second upper electrode layer 34. Side electrode layer 36 is disposed at the side of substrate 31, and electrically connected to second upper electrode layer 34. Nickel-plated layer 37 is disposed on the surfaces of second upper electrode layer 34 and side electrode layer 36. Solder plated layer 38 is disposed on the surface of nickel-plated layer 37. It is noted that nickel-plated layer 37 and solder plated layer 38 is collectively referred as a plated layer hereinafter.

Second upper electrode layer 34 contains silver particles, carbon, and a resin. The composition of the silver is between 75% by weight and 85% by weight (inclusive). The composition of the carbon is between 1% by weight and 10% by weight (inclusive). Also, the silver particles have an average particle diameter of between 0.3 μm and 2 μm (inclusive).

In resistor 100 of the present embodiment, since second upper electrode layer 34 contains an optimal amount of silver, side electrode layer 36 has good adhesion to nickel-plated layer 37 and silver, and it does not delaminate.

Figure 7:
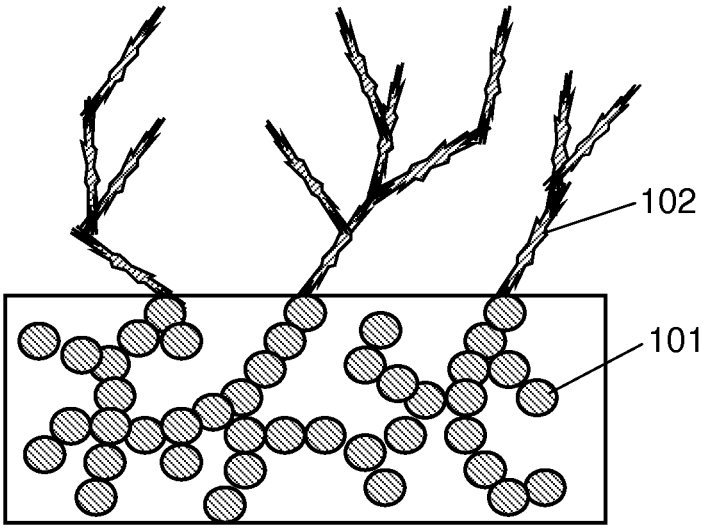
FIG. 7 is a view showing a condition of silver sulfide on a conventional silver electrode.

FIG. 7 is a view showing a condition of silver sulfide on a conventional silver electrode. Reference numeral 101 refers to a silver particle, and reference numeral 102 refers to silver sulfide. As shown in FIG. 7, when conductivity is ensured by silver particle 101 only, silver continues to be supplied, and therefore a crystal of silver sulfide 102 continues to grow.

Figure 8:
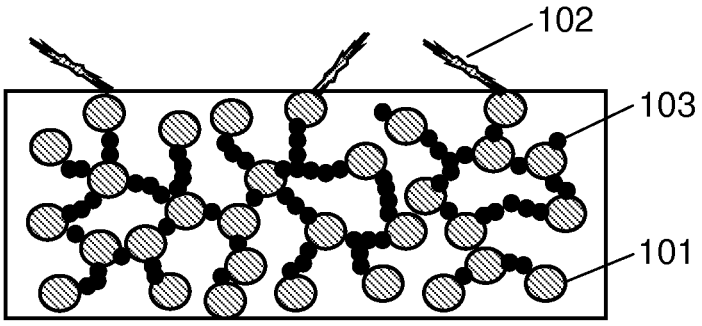
FIG. 8 is a view showing a condition of silver sulfide on a silver-carbon electrode of the present disclosure.

FIG. 8 is a view showing a condition of silver sulfide on a silver-carbon electrode of the present disclosure. Reference numeral 101 refers to a silver particle, reference numeral 102 refers to silver sulfide, and reference numeral 103 refers to a carbon particle.

In the present embodiment, as shown in FIG. 8, silver and carbon are dispersed uniformly, and silver particle 101 is independently present. Even if silver particle 101 is converted to silver sulfide 102 by sulfidizing gas, silver is not supplied continuously, and therefore silver sulfide does not precipitate at the interface between protecting layer 35 and the plated layer.

Calculating from volume of silver sulfide, when the thickness of nickel-plated layer 37 and solder plated layer 38 is 10 μm, silver sulfide having a size of 2 μm or less can not grow to silver sulfide having a size of 10 μm or more, and therefore silver sulfide does not precipitate on the surface. Further, in the plated adhesion properties of side electrode layer 36, second upper electrode layer 34 includes carbon, and therefore the side electrode layer maintains the conductivity and has improved plated adhesion properties.

Therefore, when a chip resistor is mounted to a printed circuit board of an electronic device by solder plated, a gap is not created at the interface between protecting layer 35 and a plated layer due to heat stress caused by solder plated. Even if the electronic device to which the chip resistor is mounted is used in atmosphere of sulfidizing gas, its disconnection is not caused by sulfidizing gas, the device has an effect that silver sulfide is not precipitated onto its surface from the gap between protecting layer 35 and the plated layer.

Silver particles of second upper electrode layer 34 have an average particle diameter ranging from 0.3 μm to 2 μm. If the silver particle is smaller than the range as described above, conductivity is decreased and a resistance value of second upper electrode layer 34 is increased. If the silver particle is larger than the range as described above, even one silver particle grows to a crystal of silver sulfide having a length of 10 μm or more, and the silver sulfide is precipitated from the gap between protecting layer 35 and the plated layer.

Additionally, the amount of the silver ranges from 75% by weight to 85% by weight. If the amount of silver is lower than the range as described above, side electrode layer 36 has poor adhesion to nickel-plated layer 37, and delamination is caused. If the amount of silver is higher than the range as described above, the amount of silver is so high that silver particles contact with each other, and silver continues to supply, and therefore the precipitation of silver sulfide by sulfidizing gas becomes longer, and the silver sulfide is precipitated from a gap between protecting layer 35 and the plated layer at its surface.

Then, for cost reduction, conductive powders having an average particle diameter ranging from 0.3 μm to 2 μmin that copper particles are covered with silver may also be used as conductive powders of second upper electrode layer 34.

The amount of the carbon ranges from 1% by weight to 10% by weight. If the amount of carbon is lower than the range as described above, conductivity is decreased and a resistance value of second upper electrode layer 34 is increased. If the amount of carbon is higher than the range as described above, the viscosity of an electrode material containing silver and carbon is increased, and the material provides poor print properties.

Preferred carbon is carbon having structures and conductivity. A method for producing an electrode material of second upper electrode layer 34 is as follows. First, silver, carbon, epoxy resin are taken in each amount to be formulated. Next, they are kneaded by a kneading machine (manufactured by THINKY CORPORATION, AR-250). Then, the kneaded mixture is kneaded three times continuously by a three roll kneader (manufactured by EXAKT, M50), and then silver and carbon are dispersed sufficiently.

A coupling agent may be added to the electrode material of second upper electrode layer 34 in order to improve adhesion to the electrode material of first upper electrode layer 32.

In chip resistor 100 of FIG. 3, after second upper electrode layer 34 is formed, resistor layer 33 is formed so as to cover a part of first upper electrode layer 32. Without being limited to the configuration, after first upper electrode layer 32 is formed, resistor layer 33 is formed, and then second upper electrode layer 34 may be disposed so as to cover a part of resistor layer 33.

Next, an example of a method for producing the chip resistor according to the present embodiment will be described with reference to FIGS. 4A to 4C, FIGS. 5A and 5B, and FIGS. 6A to 6C.

Figure 4A:
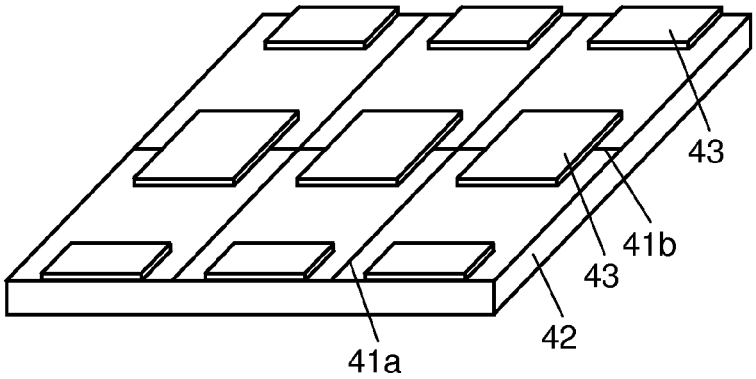
FIG. 4A is a view showing a method for producing a chip resistor according to an embodiment of the present disclosure and showing after forming a first upper electrode layer.

First, as shown in FIG. 4A, there is prepared sheet-shaped substrate 42 composed of an alumina substrate and the like having longitudinal separating groove 41*a* and lateral separating groove 41*b*. At the top surface of substrate 42, a mixed paste material including gold and glass is printed by screen printing so as to cross over lateral separating groove 41*b*, and then dried. Then, a plurality of pairs of first upper electrode layers 43 are formed by baking at a temperature of about 850° C. for about 45 minutes with belt-type continuous baking furnace.

Figure 4B:
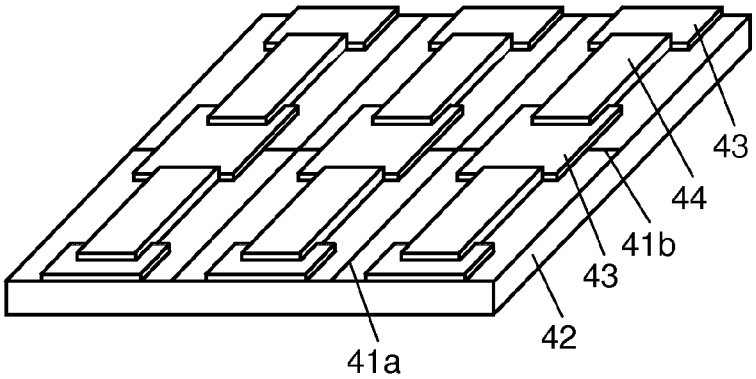
FIG. 4B is a view showing a method for producing a chip resistor according to an embodiment of the present disclosure and showing after forming a resistor layer.

Next, as shown in FIG. 4B, resistor layer 44 is formed between first upper electrode layers 43 so as to electrically connect first upper electrode layers 43. As a resistor layer, a mixed paste material of ruthenium oxide and glass is printed by screen printing so as to be overlapped with a part of first upper electrode layer 43, and then dried. Then, a plurality of resistor layers 44 are formed by baking at a temperature of about 850° C. for about 45 minutes with belt-type continuous baking furnace.

Figure 4C:
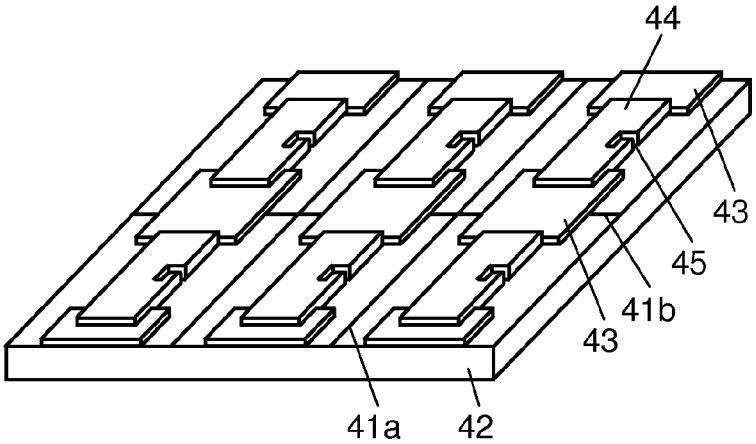
FIG. 4C is a view showing a method for producing a chip resistor according to an embodiment of the present disclosure and showing after forming a trimming groove.

Next, as shown in FIG. 4C, trimming groove 45 is formed by trimming with laser or the like in order to adjust the resistance values of the plurality of resistor layers 44. In this case, resistor layer 44 is pre-coated with glass or the like (not shown) before trimming, and then the precoat and resistor layer 44 may be trimmed to form trimming groove 45.

Figure 5A:
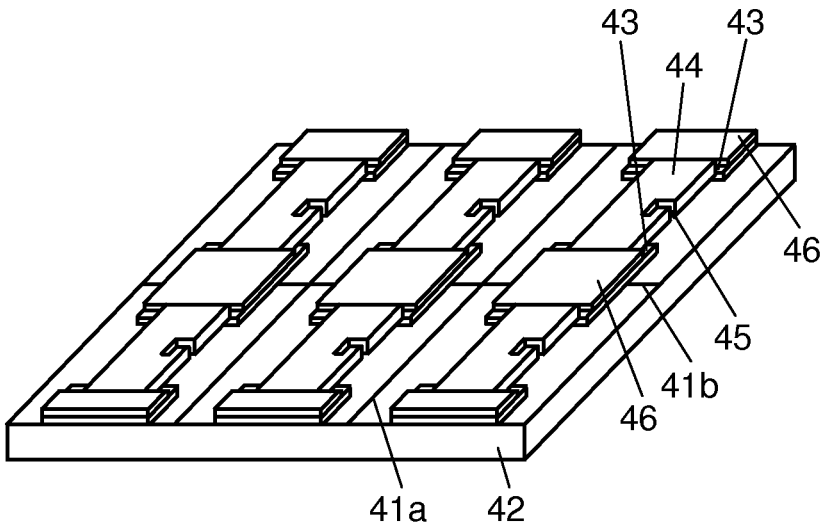
FIG. 5A is a view showing a method for producing a chip resistor according to an embodiment of the present disclosure and showing after forming a second upper electrode layer.

Next, as shown in FIG. 5A, a material of the second upper electrode layer is printed by screen printing onto top surfaces of a plurality of pairs of first upper electrode layers 43, and then dried. Then, it is cured at a temperature of about 200° C. for about 30 minutes to form a plurality of pairs of second upper electrode layers 46.

Figure 5B:
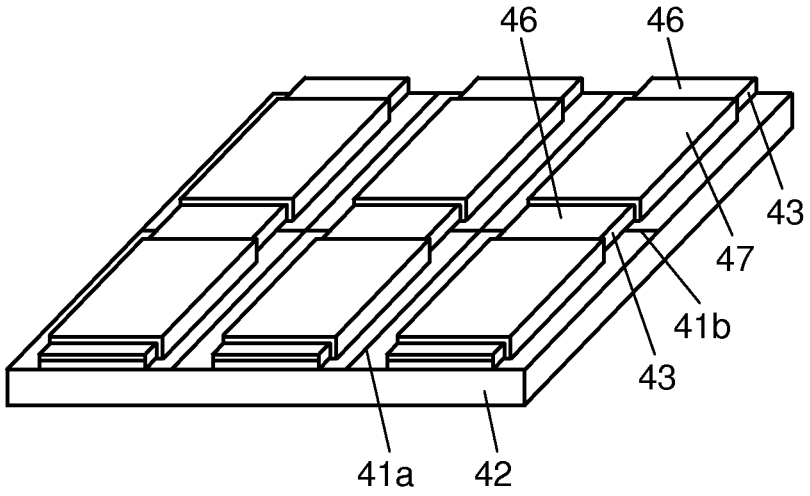
FIG. 5B is a view showing a method for producing a chip resistor according to an embodiment of the present disclosure and showing after forming a protecting layer.

Next, as shown in FIG. 5B, a lead borosilicate-based glass paste is printed by screen printing so as to cover the plurality of resistor layers 44 and a part of the plurality of pairs of second upper electrode layers 46, and then dried. Then, a plurality of protecting layers 47 are formed by baking at a temperature of about 600° C. for about 45 minutes with belt-type continuous baking furnace.

Figure 6A:
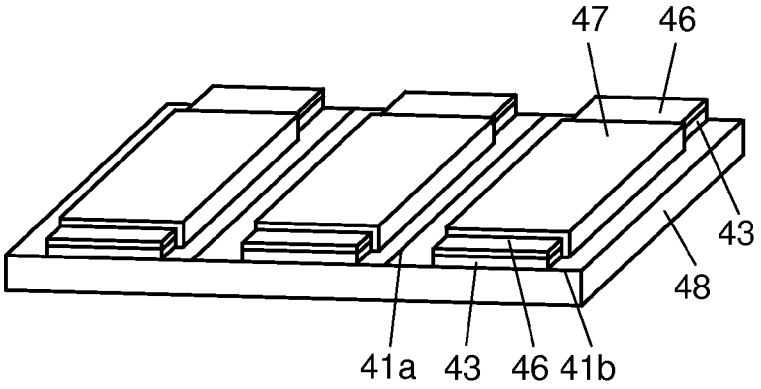
FIG. 6A is a view showing a method for producing a chip resistor according to an embodiment of the present disclosure and showing after cutting the substrate along with a lateral separating groove to form a strip-shaped substrate.

Next, as shown in FIG. 6A, strip-shaped substrate 48 is formed by cutting the substrate along with lateral separating groove 41*b* disposed on sheet-shaped substrate 42 so as to expose the pluralities of pairs of first upper electrode layers 43 and second upper electrode layers 46 from the substrate side.

Figure 6B:
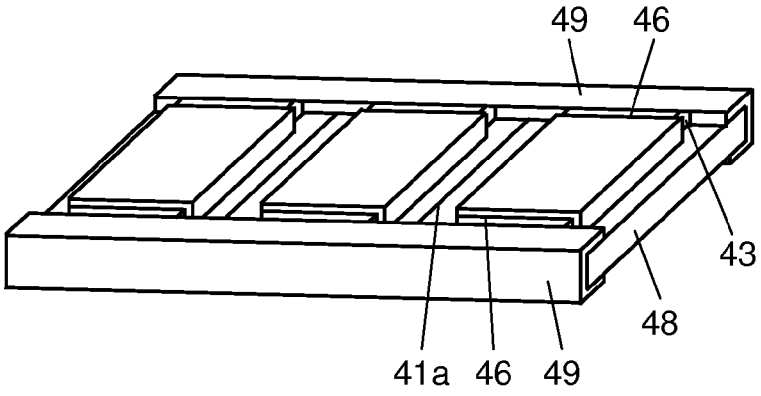
FIG. 6B is a view showing a method for producing a chip resistor according to an embodiment of the present disclosure and showing after forming a side electrode layer.

Next, as shown in FIG. 6B, a plurality of pairs of side electrode layers 49 are formed so as to connect electrically to the pluralities of pairs of first upper electrode layers 43 and second upper electrode layers 46. A silver-based resin paste material is printed by roller transfer to the side of strip-shaped substrate 48, and then dried. Then, the plurality of pairs of side electrode layers 49 are formed by curing at a temperature of about 165° C. for about 45 minutes.

Figure 6C:
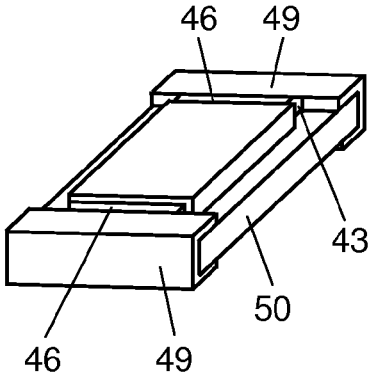
FIG. 6C is a view showing a method for producing a chip resistor according to an embodiment of the present disclosure and showing after cutting the substrate along with a longitudinal separating groove.

Next, as shown in FIG. 6C, a single piece of substrate 50 is formed by cutting strip-shaped substrate 48 including the plurality of pairs of side electrode layers 49 along with longitudinal separating groove 41*a*.

Finally, a first plated layer (not shown) composed of nickel-plate and the like is formed so as to cover second upper electrode layer 46 and side electrode layer 49. Next, a second plated layer (not shown), which is a plated alloy of tin and lead, is formed so as to cover the first plated layer to produce a chip resistor.

EXAMPLES

Next, a chip resistor of the present disclosure is produced specifically, and the results obtained by evaluating the properties thereof will be described.

Example 1

In FIG. 3, a chip resistor of the present example includes an alumina substrate as substrate 31. First upper electrode layer 32 is formed by a mixed material of gold and glass. Resistor layer 33 is formed by a mixed material of ruthenium oxide and glass. Second upper electrode layer 34 is composed of spherical silver particles having an average particle diameter of 1 μm, carbon, and an epoxy-based resin material. The composition is 78% by weight of silver particles and 5% by weight of carbon. Protecting layer 35 is made of a lead borosilicate-based glass material. Side electrode layer 36 includes silver and an epoxy-based resin material. In addition, resistor 100 includes nickel-plated layer 37, alloy plated layer of tin and lead 38.

Then, a method for producing an electrode material of second upper electrode layer 34 is as follows. As raw materials, 45 g of a silver powder (produced by Ferro, S7000-14, average particle diameter of 1 μm), 2.9 g of carbon (produced by Lion, EC600JD), 30 g of an epoxy-based resin (produced by Mitsubishi Chemical Corporation, resin with a solid content of 33 wt % obtained by dissolving JER1010 in butyl carbitol acetate), 0.7 g of a curing agent (produced by Mitsubishi Chemical Corporation, Dicy7), and 0.2 g of a curing catalyst (produced by San-Apro Ltd., Ucat-3502T) were used. First, these raw materials are kneaded by a kneading machine (manufactured by THINKY CORPORATION, AR-250). Then, the kneaded mixture was kneaded three times continuously by a three roll kneader (manufactured by EXAKT, M50), and then silver and carbon were dispersed sufficiently.

A method for producing a whole chip resistor is as described in the above embodiment.

Example 2

The configuration of a chip resistor in Example 2 is basically similar to that of Example 1. However, the composition of second upper electrode layer 34 and materials of protecting layer 35 and plated layer 38 are only different from those of Example 1. The composition of second upper electrode layer 34 in the present example is 83% by weight of silver particles and 2.5% by weight of carbon. In Example 1, a lead borosilicate-based glass paste is used as protecting layer 35; however, in the present example, an epoxy-based resin paste is used. In addition, an alloy of tin and lead is used as plated layer 38 in Example 1; however, only tin is used in the present example.

A method for producing a second electrode material is also similar to that of Example 1 except for raw materials. The raw materials include 61 g of a silver powder (produced by Ferro, S7000-14, average particle diameter of 1 μm), 1.8 g of carbon (produced by Lion, ECP), 30 g of an epoxy-based resin (produced by INCHEM, resin with a solid content of 33 wt % obtained by dissolving PKHH in butyl carbitol acetate), and 0.5 g of a coupling agent (produced by Dow Corning Toray Co., Ltd., SH6040).

A method for producing a whole chip resistor is also basically similar to that of Example 1. However, since an epoxy-based resin paste is used, the temperature of a belt-type continuous baking furnace is 200° C., and the curing time is 30 minutes.

Reference Example 1

The configuration of a chip resistor in Reference Example 1 is basically similar to that of Example 2. However, the composition of second upper electrode layer 34 is only different from that of Example 2. The composition of second upper electrode layer 34 in the present example is 73% by weight of silver particles and 2.5% by weight of carbon.

A method for producing an electrode material of second upper electrode layer 34 is also similar to that of Example 1 except for raw materials. The raw materials include 29.5 g of a silver powder (produced by Ferro, S7000-14, average particle diameter of 1 μm), 1 g of carbon (produced by Lion, EC600JD), 30 g of an epoxy-based resin (produced by Mitsubishi Chemical Corporation, resin with a solid content of 33 wt % obtained by dissolving JER1010 in butyl carbitol acetate), 0.7 g of a curing agent (produced by Mitsubishi Chemical Corporation, Dicy7), and 0.2 g of a curing catalyst (produced by San-Apro Ltd., Ucat-3502T).

A method for producing a whole chip resistor is also similar to that of Example 2.

Reference Example 2

The configuration of a chip resistor in Reference Example 2 is basically similar to that of Example 2. However, the composition of second upper electrode layer 34 is only different from that of Example 2. The composition of second upper electrode layer 34 in the present example is 75% by weight of silver particles and 0.5% by weight of carbon.

A method for producing an electrode material of second upper electrode layer 34 is also similar to that of Example 1 except for raw materials. The raw materials include 30.3 g of a silver powder (produced by Ferro, S7000-14, average particle diameter of 1 μm), 0.2 g of carbon (produced by Lion, EC600JD), 30 g of an epoxy-based resin (produced by Mitsubishi Chemical Corporation, resin with a solid content of 33 wt % obtained by dissolving JER1010 in butyl carbitol acetate), 0.7 g of a curing agent (produced by Mitsubishi Chemical Corporation, Dicy7), and 0.2 g of a curing catalyst (produced by San-Apro Ltd., Ucat-3502T).

A method for producing a whole chip resistor is also similar to that of Example 2.

Reference Example 3

The configuration of a chip resistor in Reference Example 3 is basically similar to that of Example 2. However, the composition of second upper electrode layer 34 is only different from that of Example 2. The composition of second upper electrode layer 34 in the present example is 87% by weight of silver particles and 2% by weight of carbon.

A method for producing an electrode material of second upper electrode layer 34 is also similar to that of Example 1 except for raw materials. The raw materials include 78.3 g of a silver powder (produced by Ferro, S7000-14, average particle diameter of 1 μm), 1.8 g of carbon (produced by Lion, EC600JD), 30 g of an epoxy-based resin (produced by Mitsubishi Chemical Corporation, resin with a solid content of 33 wt % obtained by dissolving JER1010 in butyl carbitol acetate), 0.7 g of a curing agent (produced by Mitsubishi Chemical Corporation, Dicy7), and 0.2 g of a curing catalyst (produced by San-Apro Ltd., Ucat-3502T).

A method for producing a whole chip resistor is also similar to that of Example 2.

Reference Example 4

The configuration of a chip resistor in Reference Example 4 is similar to that of Example 2 except for the particle size of silver in second upper electrode layer 34. Unlike Example 2, the particle size of silver in second upper electrode layer 34 is 5 μm.

A method for producing an electrode material of second upper electrode layer 34 is also similar to that of Example 1 except for raw materials. The raw materials include 61 g of a silver powder (produced by FUKUDA METAL FOIL & POWDER Co., LTD, HWQ-5 μm, average particle diameter of 5 μm), 1.8 g of carbon (produced by Lion, ECP), 30 g of an epoxy-based resin (produced by INCHEM, resin with a solid content of 33 wt % obtained by dissolving PKHH in butyl carbitol acetate), and 0.5 g of a coupling agent (produced by Dow Corning Toray Co., Ltd., SH6040).

A method for producing a whole chip resistor is also similar to that of Example 2.

Reference Example 5

The configuration of a chip resistor in Reference Example 5 is similar to that of Example 2 except for the silver particles in second upper electrode layer 34. Unlike Example 2, silver particles in second upper electrode layer 34 are flake-shaped powders, and have a particle size of about 7 μm.

A method for producing an electrode material of second upper electrode layer 34 is also similar to that of Example 1 except for raw materials. The raw materials include 61 g of a silver powder (produced by TOKURIKI HONTEN CO. LTD., TC-25A, flake-shaped particle size of 7 μm), 1.8 g of carbon (produced by Lion, ECP), 30 g of an epoxy-based resin (produced by INCHEM, resin with a solid content of 33 wt % obtained by dissolving PKHH in butyl carbitol acetate), and 0.5 g of a coupling agent (produced by Dow Corning Toray Co., Ltd., SH6040).

A method for producing a whole chip resistor is also similar to that of Example 2.

(Evaluation of Sample)

Samples produced in the examples were evaluated for sulfidizing gas test, adhesion test for plated, and conductivity.

The sulfidizing gas test was carried out as follows. Samples were used which were obtained by mounting chip resistors in respective examples to a printed circuit board by flow soldering. These samples were exposed to sulfidizing gas. The conditions of the sulfidizing gas test are as follows: the samples are allowed to stand in an atmosphere at 40° C., 95% RH, and with a concentration of sulfidizing gas of 3 ppm for 2000 hours. After keeping the samples in the conditions, precipitation of silver sulfide at the surfaces of protecting layer 35 and a plated layer was observed.

In the adhesion test for plated, the chip resistor itself in each example was used as a sample. A cellophane tape was attached to a plated area of the chip resistor, and then removed. At that time, it was evaluated whether or not the plated layer was delaminated from second upper electrode layer 34.

In the evaluation of conductivity in second upper electrode layer 34, a chip resistor itself was not used as a sample, but in place of that, a sample obtained by printing a material of second upper electrode layer 34 in each example to a glass substrate in 3 mm×70 mm width, followed by curing was used. The resistance value of sheet resistance was calculated by converting the sample into one with a thickness of 10 μm.

TABLE 1

| | Silver particle | Carbon | Sulfidizing gas test | Adhesion test for plating | Conductivity (Ω/□) |
|---|---|---|---|---|---|
| Reference Example 1 | Spherical powder 1 μm 73% by weight | 2.5% by weight | No generation of silver sulfide | Generation of delamination | 13080 |
| Reference Example 2 | Spherical powder 1 μm 75% by weight | 0.5% by weight | No generation of silver sulfide | No generation of delamination | No conductive |
| Example 1 | Spherical powder 1 μm 78% by weight | 5% by weight | No generation of silver sulfide | No generation of delamination | 315 |
| Example 2 | Spherical powder 1 μm 83% by weight | 2.5% by weight | No generation of silver sulfide | No generation of delamination | 27 |
| Reference Example 3 | Spherical powder 1 μm 87% by weight | 2% by weight | Generation of silver sulfide | No generation of delamination | 3 |
| Reference Example 4 | Spherical powder 5 μm 83% by weight | 2.5% by weight | Generation of silver sulfide | No generation of delamination | 1330 |
| Reference Example 5 | Flake powder 7 μm 83% by weight | 2.5% by weight | Generation of silver sulfide | No generation of delamination | 0.1 |

The evaluation results of the samples are summarized in Table 1. From Table 1, it can be seen as follows.

As Reference Example 4, if the size of the silver particle is as large as 5 μm or more, the sample tends to generate silver sulfide easily in the sulfidizing gas test. Likewise, as Reference Example 3, if the concentration of silver is as high as 87% by weight or more, the sample tends to generate silver sulfide easily.

On the other hand, as Reference Example 1, if the concentration of silver is as low as 73% by weight or less, the sample has poor adhesion to plated, and its delamination is caused.

On the other hand, as Reference Example 2, even if 75% by weight of a spherical powder with a size of 1 μm is used as a silver particle, the sample has insufficient conductivity because of 0.5% of carbon.

INDUSTRIAL APPLICABILITY

The present disclosure is useful as a chip resistor without causing the disconnection in atmosphere of sulfidizing gas and without precipitating silver sulfide on its surface.

REFERENCE MARKS IN THE DRAWINGS

1 insulating substrate
2 upper electrode layer
3 resistor layer
4 trimming groove
5 protecting layer
6 side electrode layer
7 nickel-plated layer
8 solder plated layer
31 substrate
32 first upper electrode layer
33 resistor layer
34 second upper electrode layer
35 protecting layer
36 side electrode layer
37 nickel-plated layer
38 solder plated layer
39 trimming groove
separating groove
separating groove
42 substrate
43 first upper electrode layer
44 resistor layer
45 trimming groove
46 second upper electrode layer
47 protecting layer
48 strip-shaped substrate
49 side electrode layer
50 single piece of substrate
101 silver particle
102 silver sulfide
103 carbon particle

The invention claimed is:

1. A chip resistor comprising:

a substrate having a top surface;

a resistor layer disposed on the top surface of the substrate;

a pair of first upper electrode layers disposed on the top surface of the substrate and being electrically connected to the resistor layer at both sides of the resistor layer;

a pair of second upper electrode layers disposed on the pair of first upper electrode layers and including between 75% by weight and 85% by weight (inclusive) of silver particles with an average particle diameter ranging from 0.3 μm to 2 μm, between 1% by weight and 10% by weight (inclusive) of carbon, and a resin; and a protecting layer disposed so as to cover all of an upper surface of the resistor layer and part of upper surfaces of the pair of second upper electrode layers.

2. The chip resistor according to claim 1, further comprising:

a pair of side electrode layers disposed at both sides of the substrate, the pair of side electrode layers being electrically connected to the pair of second upper electrode layers.

3. The chip resistor according to claim 2, further comprising:

a plated layer disposed on the upper surfaces of the pair of second upper electrode layers and the pair of side electrode layers.

4. The chip resistor according to claim 2, further comprising a pair of nickel-plated layers disposed so as to cover the upper surfaces of the pair of second upper electrode layers and upper surfaces of the pair of side electrode layers, the pair of nickel-plated layers directly contacting with the protecting layer at both sides of the protecting layer, wherein interfaces of the pair of nickel-plated layers and the protecting layer are located above the pairs of first electrode layers.

5. The chip resistor according to claim 4, further comprising a pair of solder layers disposed on the top surface of the pair of nickel-plated layers and directly contacting with the protecting layer at both sides of the protecting layer, wherein interfaces of the pair of solder layers and the protecting layer are located above the pairs of first electrode layers.

6. The chip resistor according to claim 1, wherein the pair of first upper electrode layers is larger than the pair of second upper electrode layers.

7. The chip resistor according to claim 1, wherein a composition of the pair of first upper electrode layers is different from a composition of the pair of second upper electrode layers.

8. The chip resistor according to claim 1, wherein the pair of second upper electrode layers directly contact with the resistor layer at both sides of the resistor layer.

9. The chip resistor according to claim 1, wherein the silver particles are copper particles covered with silver.

10. A method for producing a chip resistor comprising the steps of:

providing a pair of first electrode layers on a top surface of a substrate;

providing a resistor layer between the pair of first electrode layers, both sides of the resistor layer being electrically connected to the pair of first electrode layers;

providing a pair of second upper electrode layers on the pair of first upper electrode layers, the pair of second upper electrode layers including between 75% by weight and 85% by weight (inclusive) of silver particles with an average particle diameter ranging from 0.3 μm to 2 μm, between 1% by weight and 10% by weight (inclusive) of carbon, and a resin; and providing a protecting layer so as to cover all of an upper surface of the resistor layer and part of an upper surface of each of the pair of second upper electrode layers.

* * * * *